US008616583B2

(12) United States Patent
Davis

(10) Patent No.: US 8,616,583 B2
(45) Date of Patent: Dec. 31, 2013

(54) REUSABLE NOTECARD AND METHODS OF USE THEREOF

(76) Inventor: Milana D. Davis, Los Angeles, CA (US)

( * ) Notice: Subject to any disclaimer, the term of this patent is extended or adjusted under 35 U.S.C. 154(b) by 343 days.

(21) Appl. No.: 13/045,898

(22) Filed: Mar. 11, 2011

(65) Prior Publication Data

US 2011/0221181 A1 Sep. 15, 2011

Related U.S. Application Data

(60) Provisional application No. 61/313,090, filed on Mar. 11, 2010.

(51) Int. Cl.
*B42D 19/00* (2006.01)

(52) U.S. Cl.
USPC ..... 281/14; 281/38; 40/124.2; 40/124.06; 40/124.09

(58) Field of Classification Search
USPC ..... 40/124.09, 124.2, 539; 281/14; 248/174
See application file for complete search history.

(56) References Cited

U.S. PATENT DOCUMENTS 3,990,578 A * 11/1976 Roeser ..... 206/461
6,006,927 A * 12/1999 Levy ..... 211/51
6,070,347 A * 6/2000 Hergott ..... 40/320
6,453,592 B1 * 9/2002 Pliler et al. ..... 40/776
7,134,231 B1 * 11/2006 Becker ..... 40/658
7,568,853 B2 * 8/2009 Laufer ..... 402/73
2003/0178837 A1 * 9/2003 Ung et al. ..... 281/9
2003/0205489 A1 * 11/2003 Shumake et al. ..... 206/224
2009/0068632 A1 * 3/2009 Thompson et al. ..... 434/416
2010/0018090 A1 * 1/2010 Dickert ..... 40/124.08
2010/0170125 A1 * 7/2010 Taylor et al. ..... 40/661

* cited by examiner

*Primary Examiner* — Dana Ross
*Assistant Examiner* — Homer Boyer
(74) *Attorney, Agent, or Firm* — Heidi L. Eisenhut; Loza & Loza, LLP

(57) ABSTRACT

Embodiments of the invention are directed to reusable notecard. In one embodiment, the reusable notecard is comprised of a trifold panel having a left panel, a center panel and a right panel and a reclosable closing mechanism, connected to the trifold panel, to releasably secure the left panel to the right panel when folded over one another. In one embodiment, the adjustable left panel is comprised of a plurality of left panel fold lines and the right panel is comprised of a plurality of right panel fold lines, the plurality of left panel fold lines and the plurality of right panel fold lines for adapting to dimensions of contents inside the notecard. In one embodiment, the trifold panel is made of a material allowing for non-permanent markings.

11 Claims, 13 Drawing Sheets

REUSABLE NOTECARD AND METHODS OF USE THEREOF

CLAIM OF PRIORITY UNDER 35 U.S.C. §119

The present Utility Application for Patent claims priority to U.S. Provisional Patent Application No. 61/313,090 entitled "Reusable Notecards & Methods of Use Thereof" filed Mar. 11, 2010, and hereby expressly incorporated by reference herein.

FIELD OF INVENTION

At least one feature pertains to a reusable notecard.

BACKGROUND OF INVENTION

A "sticky note" is a piece of stationery with a re-adherable strip of adhesive on the back, designed for temporarily attaching notes to documents and to other surfaces such as walls, desks and table-tops, computer displays, etc. Despite its re-adherable strip, a sticky note is often used a single time before being discarded. This is due to that one generally writes a note or notes on the sticky note rendering it unusable for writing a different note or notes. With the increase in awareness of environmental issues, including paper recycling, use of sticky notes may be considered by some to be wasteful. This is especially true in view of that re-adherable strip may render a sticky note non-recyclable.

Consequently, an alternative device and method which alleviates problems of the prior art as discussed previously are needed.

SUMMARY

One feature provides a reusable notecard. The reusable notecard comprises (i) a trifold panel having a left panel, a center panel and a right panel; and (ii) a reclosable closing mechanism, connected to the trifold panel, to releasably secure the left panel to the right panel when folded over one another, wherein the trifold panel is one in which non-permanent markings may be made.

In yet another feature, the reclosable closing mechanism reclosable closing mechanism comprises a fastening member and a first opening to receive the fastening member wherein a circumference of the first opening is greater than a circumference of the fastening member. Furthermore, the reclosable closing mechanism comprises a second opening adjacent to, and in communication with, the first opening, located closest to an edge of the right panel; and wherein the second opening is smaller than the first opening and serves to releasably secure the left panel to the right panel.

In yet another feature, the reclosable closing mechanism comprises a tab, integrally positioned on the left or the right panel, and a slit to receive the tab wherein the slit is sized to receive the widest portion of the tab.

In yet another feature, a reusable notecard is provided. The reusable notecard comprises (i) a trifold panel having an adjustable left panel, a center panel and an adjustable right panel; and (ii) a reclosable closing mechanism, connected to the trifold panel, to releasably secure the adjustable left panel to the adjustable right panel when folded over one another. The reclosable closing mechanism comprises a fastening member; and a first opening to receive the fastening member, wherein a circumference of the first opening is greater than a circumference of the fastening member. The trifold panel is one in which non-permanent markings may be made. The adjustable left panel comprises a plurality of left panel fold lines and the adjustable right panel comprises a plurality of right panel fold lines, the plurality of left panel fold lines and the plurality of right panel fold lines for adapting to dimensions of contents inside the notecard.

In yet another feature, a reusable notecard is provided. The reusable notecard comprises (i) a trifold panel having an adjustable left panel, a center panel and an adjustable right panel; and (ii) a reclosable closing mechanism, integrally connected to the trifold panel, to releasably secure the left panel to the right panel when folded over one another. The reclosable closing mechanism comprises a tab integrally connected to the left panel; and a slit located within the right panel to receive the tab, wherein the slit is sized to receive the widest portion of the tab. The trifold panel is one in which non-permanent markings may be made.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

The following detailed description is of the best currently contemplated modes of carrying out the invention. The description is not to be taken in a limiting sense, but is made merely for the purpose of illustrating the general principles of the invention.

Figure 1A:
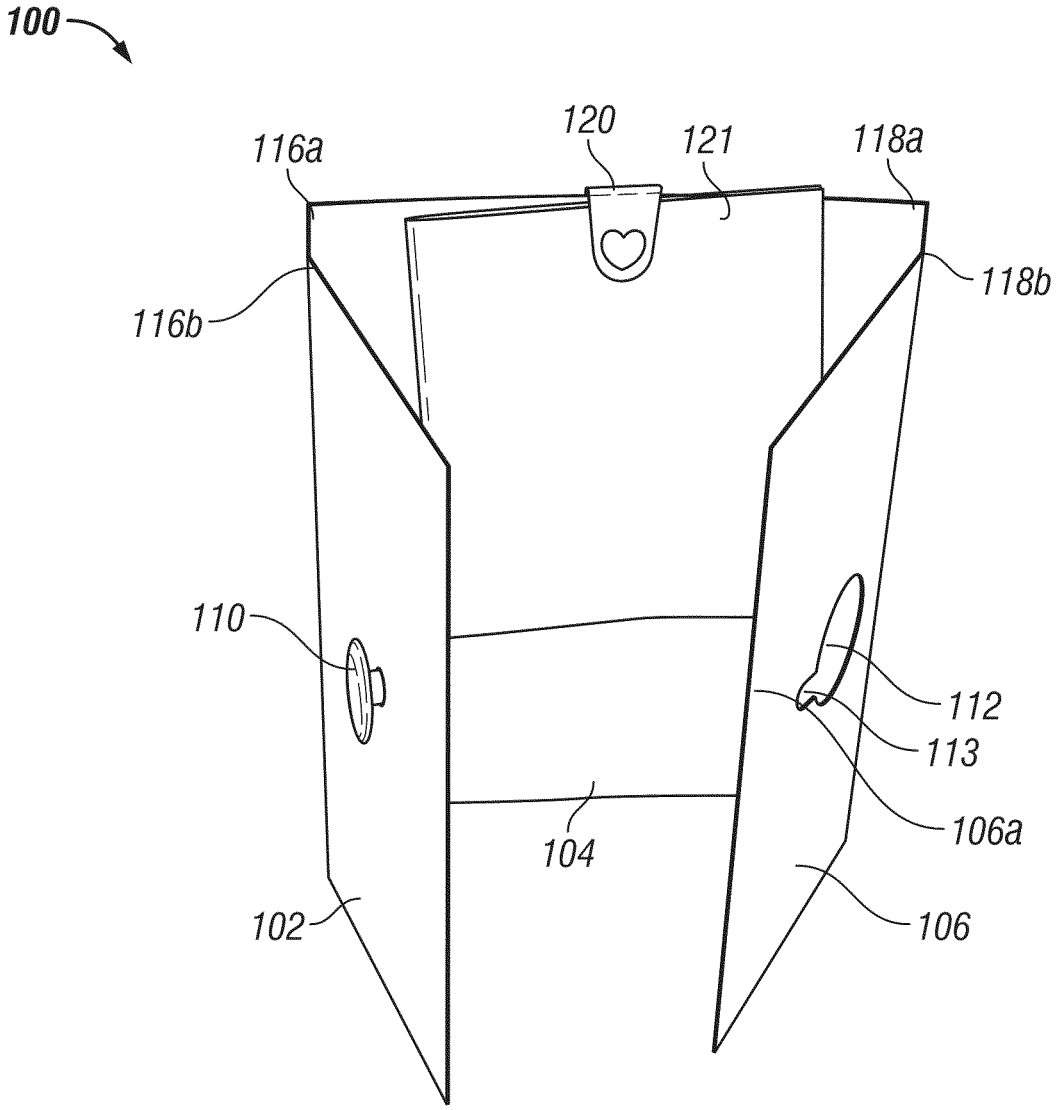
FIG. 1A is a front perspective view of a reusable notecard in a partially open configuration, according to an embodiment of the invention.

FIG. 1A is a front perspective view of a reusable notecard according to an embodiment of the invention. According to this embodiment, reusable notecard 100 has a trifold configuration; however, other suitable configurations are within the scope of the invention. Reusable notecard 100 may be partially, substantially or completely made of one or more sheets of material in which non-permanent markings may be made. Such materials include, but are not limited to, poly laminate and vinyl, laminated paper or any other suitable material. At any rate, notecard 100 should be made of a flexible yet durable and relatively stiff material. In the trifold configuration, reusable notecard 100 includes a left panel 102, a center panel 104 and a right panel 106. Reusable notecard 100 may be approximately eight (8) inches in width and four (4) inches in height; thus, in one embodiment, left and right panels 102, 106 may be approximately two and one-half inches (2 and ½) inches in width and center panel 104 may be approximately three (3) inches in width, although other heights and widths are within the scope of the invention. For example, reusable notecard 100 may be approximately eight (8) and a quarter (¼) inches in width and four (4) and a quarter (¼) inches in height; thus, in one embodiment, left and right panels 102, 106 may be approximately two and five eighths inches (2 and ⅝) inches in width and center panel 104 may be approximately three (3) inches in width Panels 102, 104 and 106 may be created by pressing parallel, spaced-apart crease lines in notecard 100 to define fold lines. Panels 102, 104 and 106 may be generally rectangular in shape. However, in alternative embodiments, the panels may be other shapes, such as squares, ovals or other polygons. As shown in FIG. 1A, notecard 100 may include a plurality of left panel fold lines 116*a* and 116*b* and a plurality of right panel fold lines 118*a* and 118*b*. Multiple fold lines may be included to create an expandable notecard 100 such that notecard 100 may be adapted to the dimensions of contents which may be included inside notecard, such as a note, lunch card, money, etc. Although two right and left panel fold lines are shown, this is by way of example only and more or less fold lines may be included. In any embodiment, reusable notecard 100 may be approximately pocket-sized.

In one embodiment, center panel 104 may include an attaching member 120, such as a clip, for securing contents 121, such as a note, lunch card and money, to the notecard 100. Attaching member 120 may be detachably or fixedly secured to notecard 100. Although attaching member 120 is shown secured to top of center panel 104, this is by way of example only and attaching member may be secured to any panel at the top, bottom or sides.

Figure 1B:
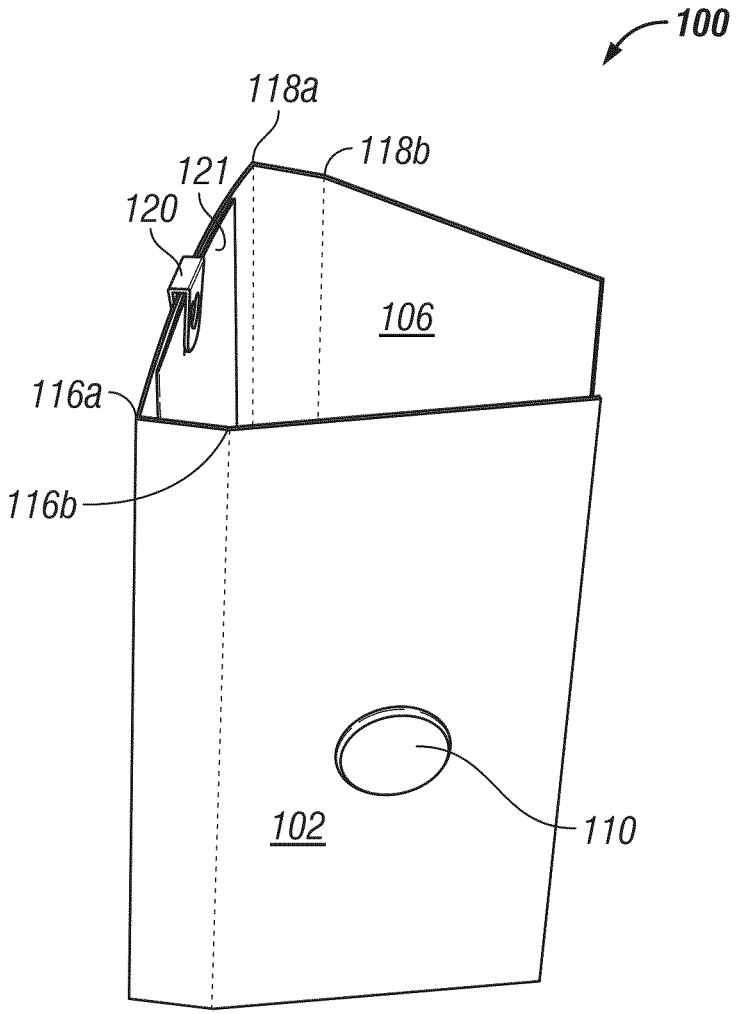
FIG. 1B is a left panel perspective view of the reusable notecard of FIG. 1A.
Figure 1C:
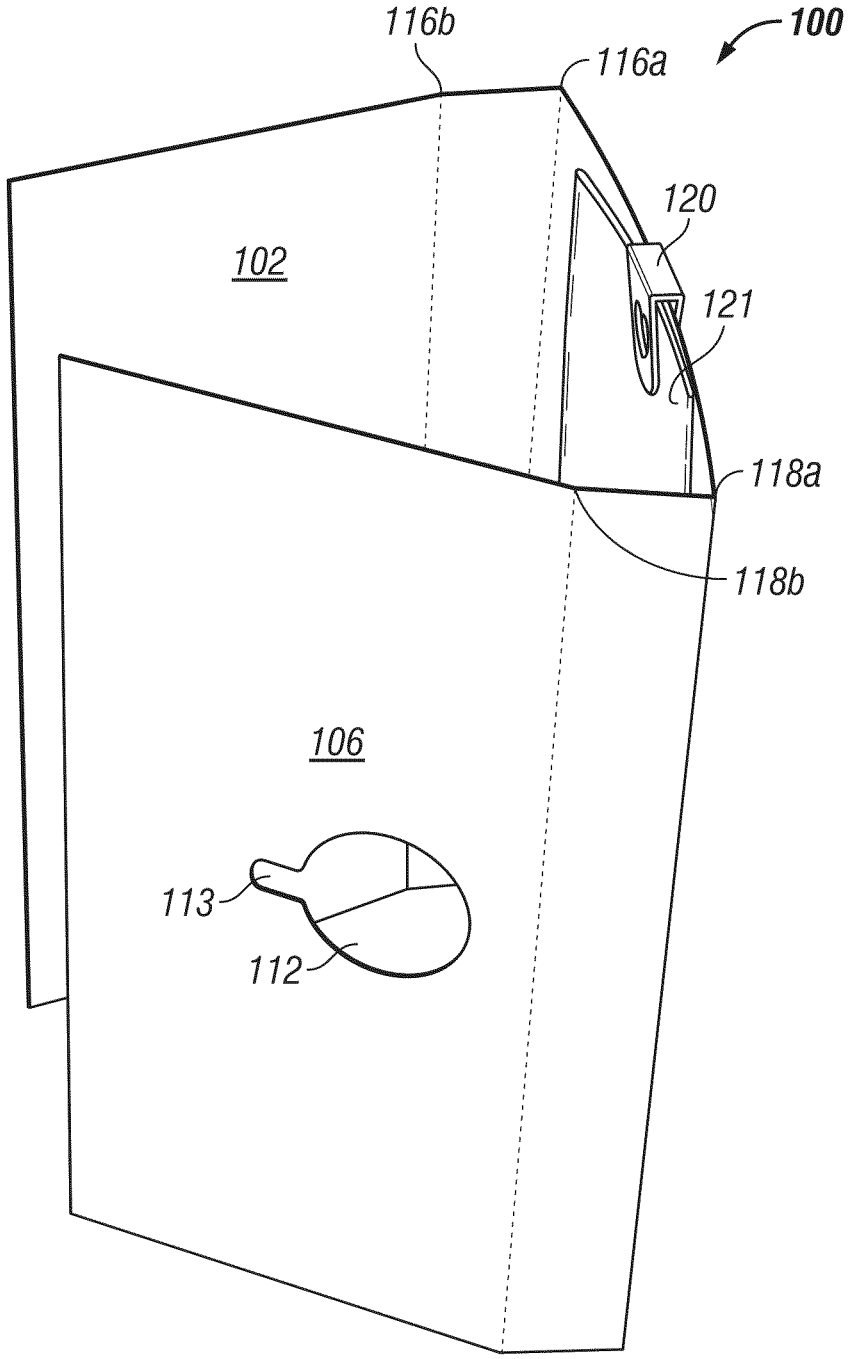
FIG. 1C is a right panel perspective view of the reusable notecard of FIG. 1A.
Figure 1D:
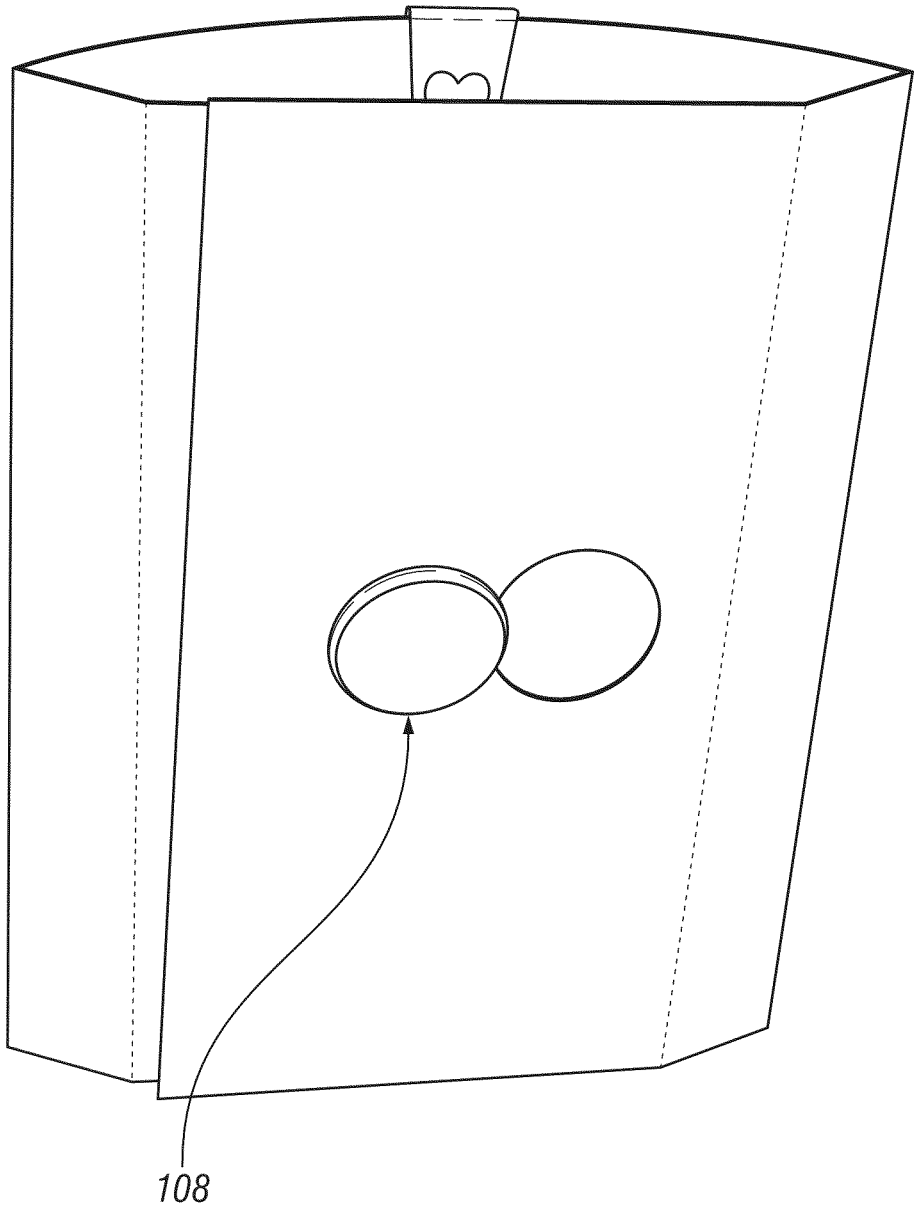
FIG. 1D is a front perspective view of the reusable notecard of FIG. 1A in a closed configuration.

FIGS. 1B-1C are left and right panel perspective views, respectively, of the reusable notecard of FIG. 1A. Reusable notecard 100 may include a reclosable closing mechanism 108 integrally connected to reusable notecard 100. In one embodiment, reclosable closing mechanism 108 (see FIG. 1D) includes a fastening member, such as a button, 110 and an opening 112 to receive button 110 (see FIG. 1A). Opening 112 may have a greater circumference relative to a circumference of button 110. In one embodiment, button 110 may be positioned on an outside surface of left panel 102 and approximately off-centered thereto. Button 110 may be secured to left panel 102 by a brad, split pin or any other suitable means. Opening 112 may be located on right panel 106 and approximately centered thereto.

Figure 1E:
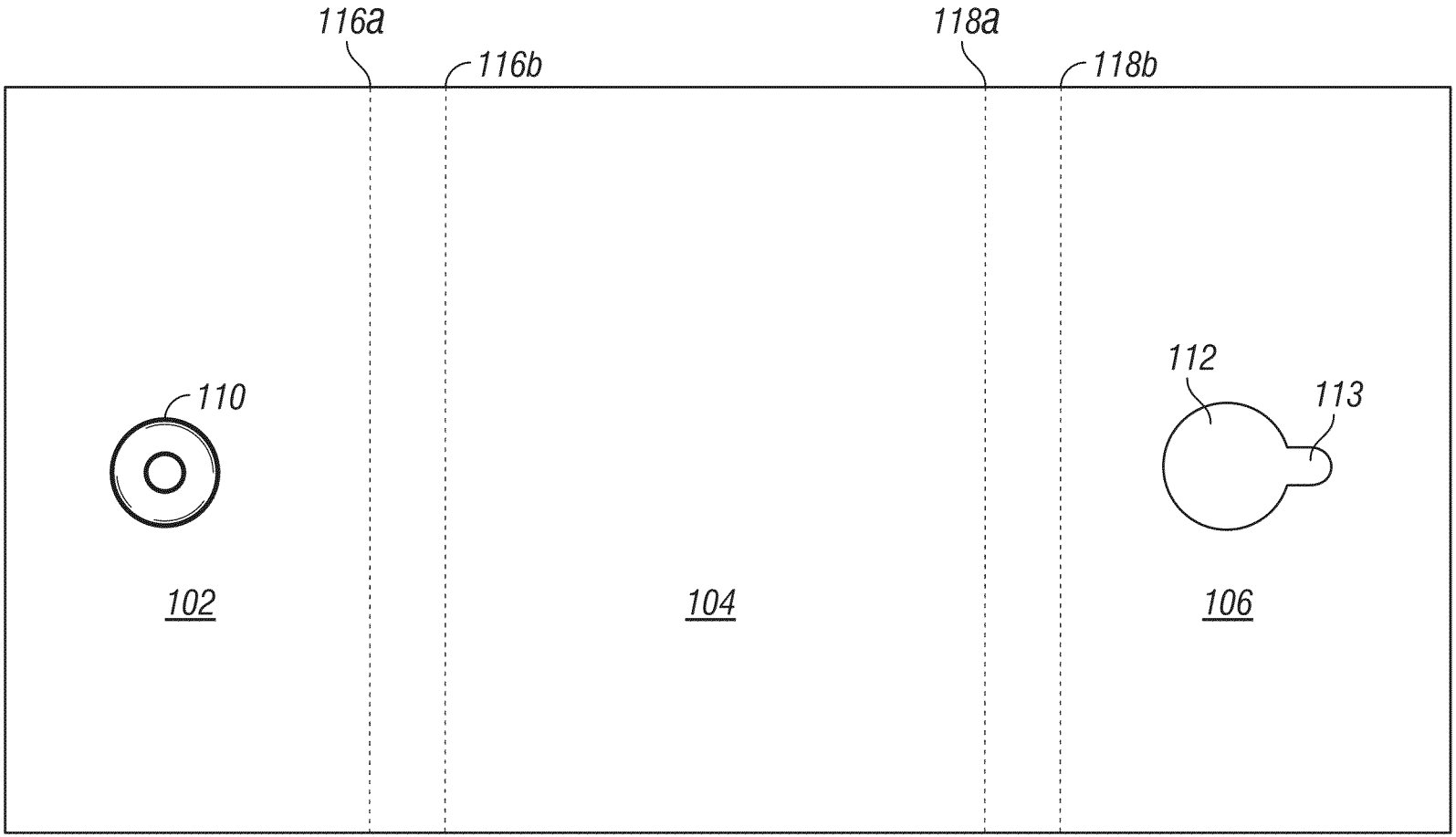
FIG. 1E is an outer plan view of the reusable notecard of FIG. 1A in a flat open configuration.
Figure 1F:
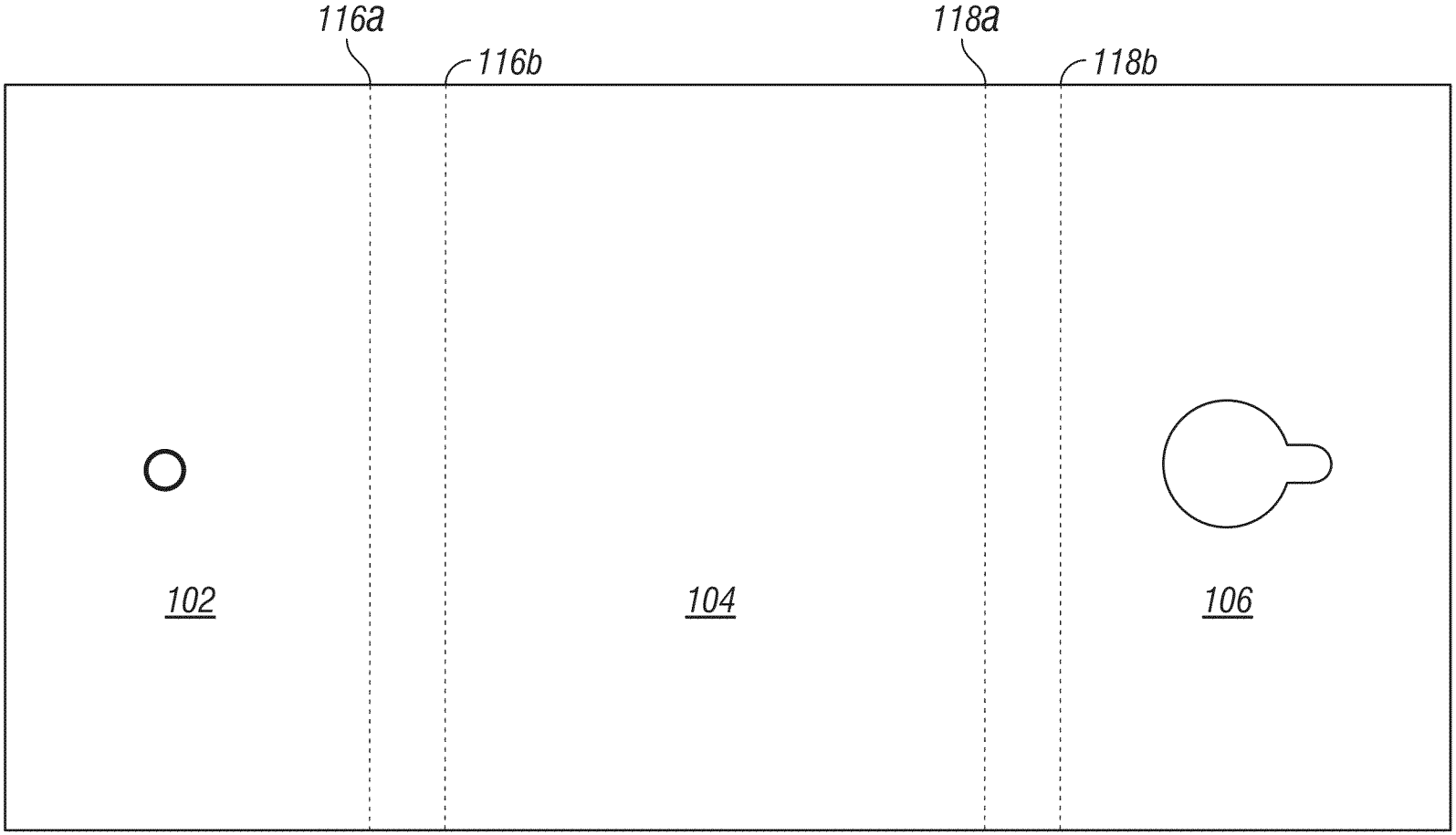
FIG. 1F is an inner plan view of the reusable notecard of FIG. 1A in a flat open configuration.

Opening 112 may also include an additional smaller opening 113 (relative to opening 112) in open communication with opening 112. In one embodiment, the smaller opening 113 is adjacent to opening 112 located closest to an edge 106*a* of right panel 106. The smaller opening 113 may serve to releasably secure left panel 102 to right panel 106 or vice-versa. For example, after an erasable note has been written on an inside surface of center panel 104 (also left and right panels, 102, 106, if appropriate), a user may fold left panel 102 over center panel 104. Then, the user may fold right panel 106 over left panel 102. Button 110 may then be inserted into opening 112. Due to the positioning of button 110, opening 112 and the smaller opening 113, in addition to the flexibility and stiffness of the material of notecard 100, releasing left and right panels 102, 106 naturally causes the reclosable closing mechanism 108 to releasably "lock" into place (see FIG. 1D) in the smaller opening 112. More specifically, a stem of button 110 may naturally slide into the smaller opening 113 thereby releasably locking button 110 into place. FIGS. 1E-1F are outer and inner plan views, respectively, of the reusable notecard of FIG. 1A in a flat open configuration.

Figure 2A:
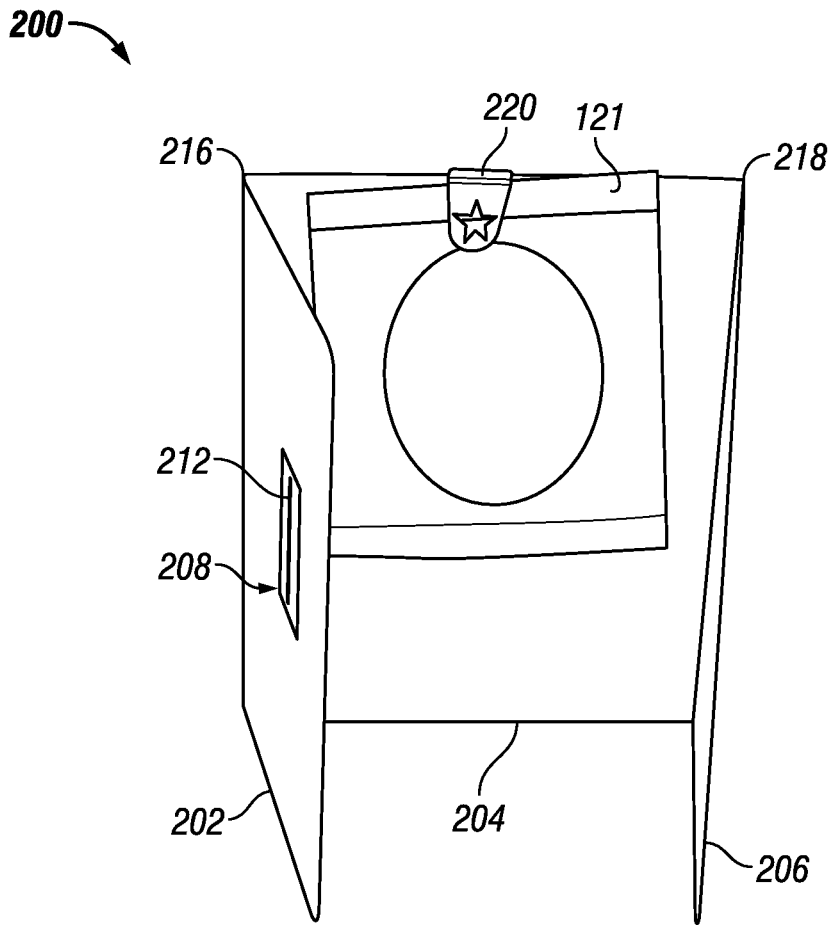
FIG. 2A is a front perspective view of a reusable notecard in a partially open configuration, according to an alternative embodiment of the invention.

FIG. 2A is a front plan view of a reusable notecard according to an alternative embodiment of the invention. Similar to FIG. 1A and according to this embodiment, reusable notecard 200 has a trifold configuration; however, other suitable configurations are within the scope of the invention. Similar to FIG. 1A, reusable notecard 200 may be partially, substantially or completely made of a material in which non-permanent markings may be made. Such materials include, but are not limited to, poly laminate and vinyl, laminated paper or any other suitable material. In any embodiment, notecard 200 should be made of a flexible yet durable and relatively stiff material. In the trifold configuration, reusable notecard 200 includes an adjustable left panel 202, a center panel 204 and a right panel 206. Reusable notecard 200 may be approximately eight (8) inches in width and four (4) inches in height; thus, in one embodiment, left and right panels 202, 206 may be approximately two and one-half inches (2 and ½) inches in width and center panel 204 may be approximately three (3) inches in width, although other heights and widths are within the scope of the invention.

Panels 202, 204 and 206 may be created by pressing parallel, spaced-apart crease lines in notecard 200 to define fold lines. Panels 202, 204 and 206 may be generally rectangular in shape. However, in alternative embodiments, the panels may be other shapes, such as squares, ovals or other polygons. As shown in FIG. 2A, notecard 200 may include a left panel fold line 216 and a right panel fold line 218. Multiple fold lines may be included to create an expandable notecard 200 such that notecard 200 may be adapted to the dimensions of contents which may be included inside notecard, such as a note, lunch card, money, etc. Although one right panel fold line 216 and left panel fold line 218 are shown, this is by way of example only and more fold lines may be included. In any embodiment, reusable notecard 200 should be approximately pocket-sized.

In one embodiment, center panel 204 may include an attaching member 220, such as a clip, for securing contents 221, such as a note, lunch card and money, to the notecard 200. Attaching member 220 may be detachably or fixedly secured to notecard 200. Although attaching member 220 is shown secured to top of center panel 204, this is by way of example only and attaching member may be secured to any panel at the top, bottom or sides.

Figure 2B:
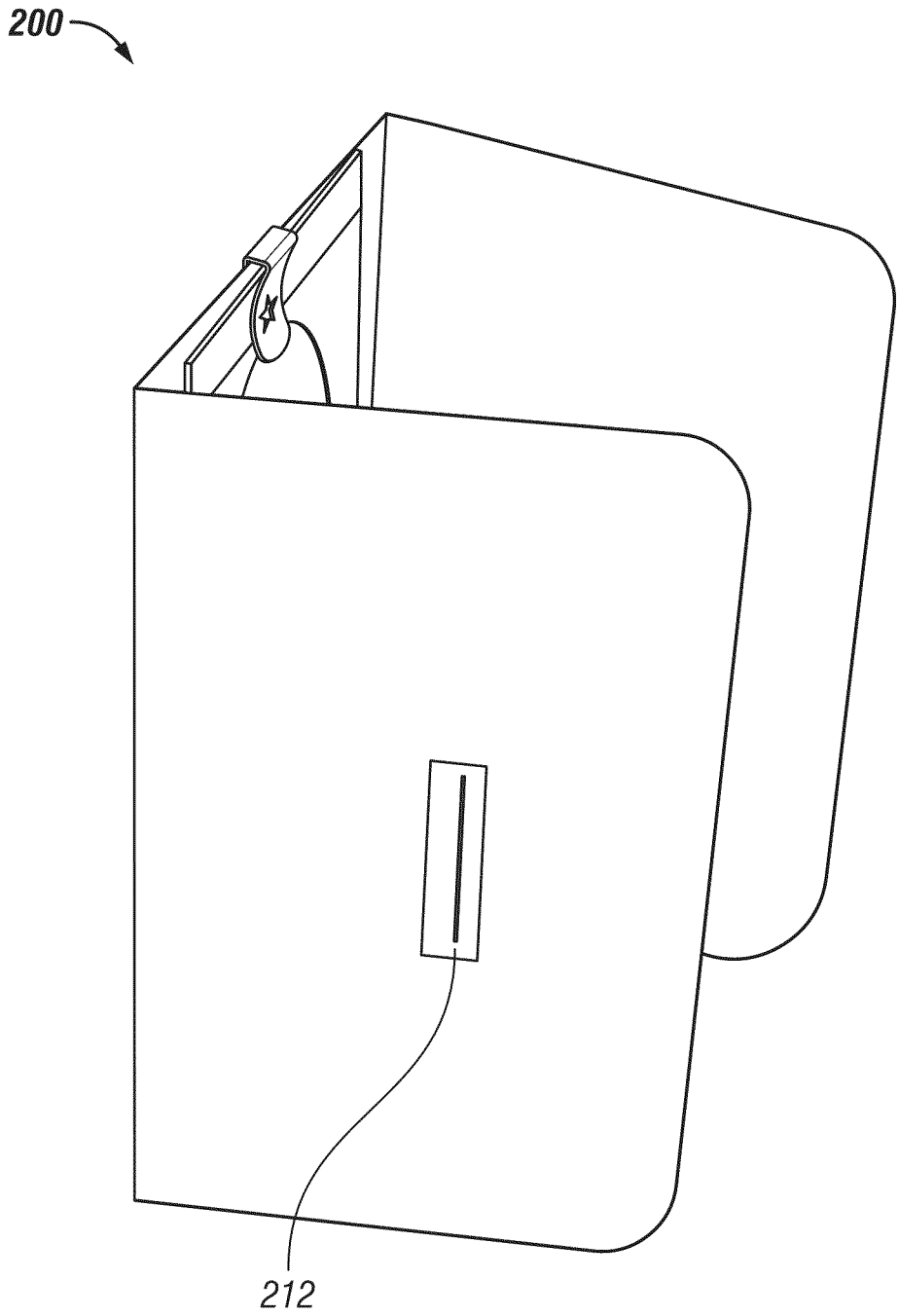
FIG. 2B is a left panel perspective view of the reusable notecard of FIG. 2A.
Figure 2C:
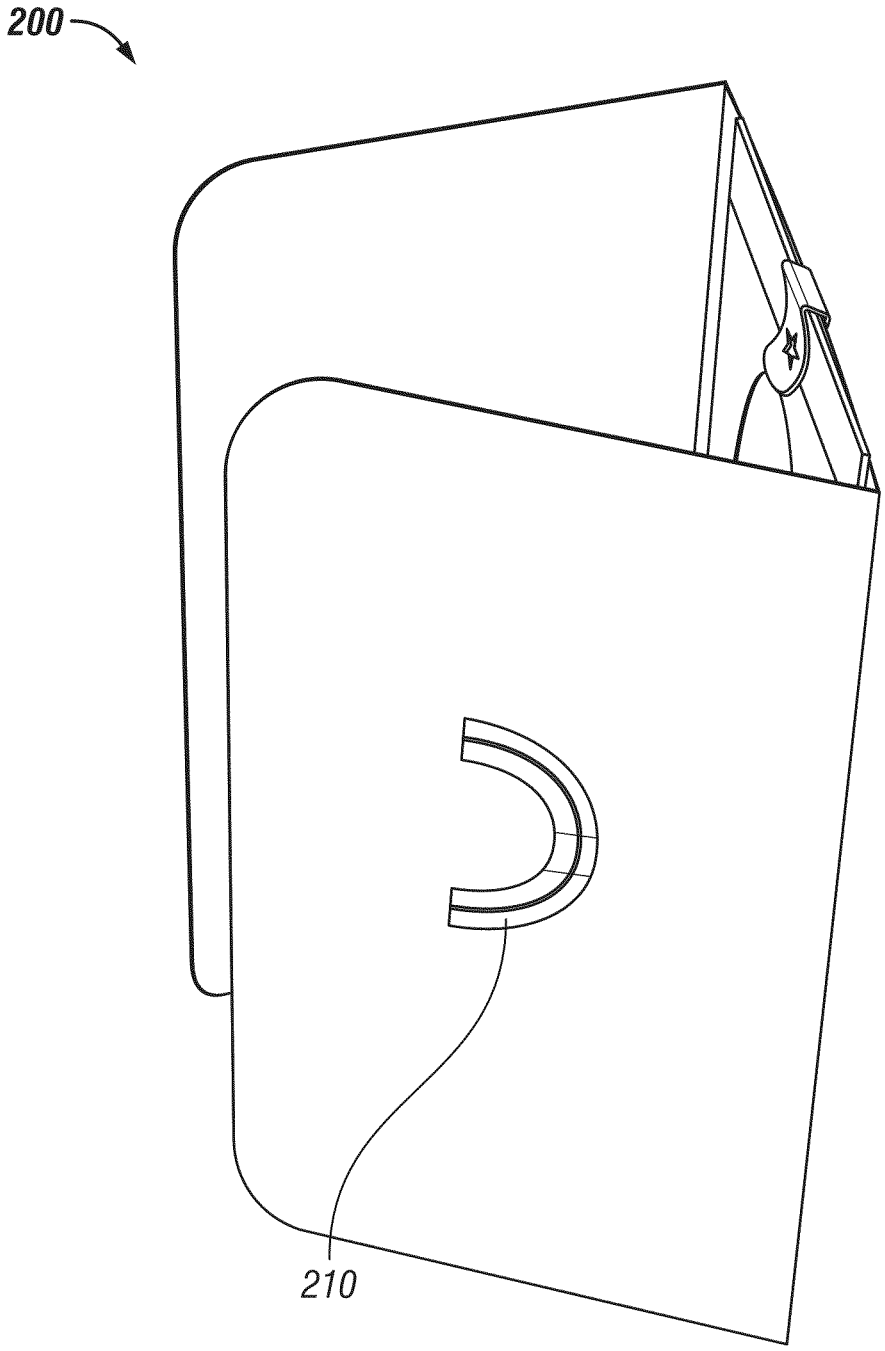
FIG. 2C is a right panel perspective view of the reusable notecard of FIG. 2A.
Figure 2D:
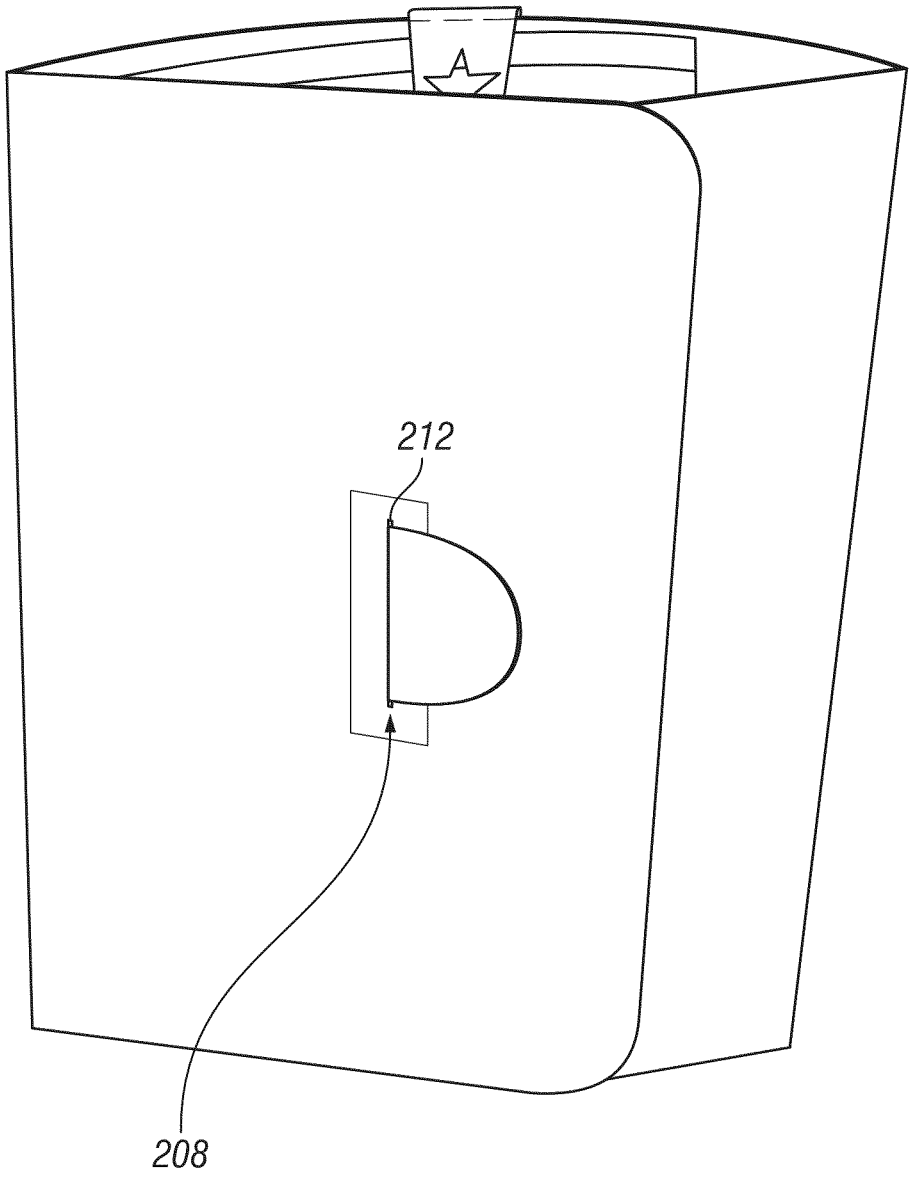
FIG. 2D is a front perspective view of the reusable notecard of FIG. 2A in a closed configuration.

FIGS. 2B-2C are left and right panel perspective views, respectively, of the reusable notecard of FIG. 2A. Reusable notecard 200 may include a reclosable closing mechanism 208. In one embodiment, reclosable closing mechanism 208 (see FIG. 2D) includes a tab 210 and an opening 212 to receive tab 210. Opening or slit 212 may be sized to receive tab 210 at its widest diameter. In one embodiment, tab 210 may be positioned on an outside surface of right panel 206 and approximately off-centered thereto. Opening 212 may be located on left panel 202 and approximately off-centered thereto. In one embodiment, tab 210 may be formed by cutting an interior portion of the right panel 206 such that tab 210 is integrally formed into right panel 206.

Slit 212 may serve to releasably secure left panel 202 to right panel 206 or vice-versa. For example, after an erasable note has been written on an inside surface of center panel 204 (also left and right panels, 202, 206, if appropriate), a user may fold left panel 202 over center panel 204. Then, the user may fold right panel 206 over left panel 202. Tab 210 may then be inserted into slit 212. Due to the positioning of tab 210, slit 212, in addition to the flexibility and stiffness of the material of notecard 200, releasing left and right panels 202, 206 naturally causes the reclosable closing mechanism 208 to releasably "lock" into place (see FIG. 2D). More specifically, tab 210 naturally slides into slit 212 until it reaches a base of tab 210 thereby releasably locking tab 210 into place.

Figure 3A:
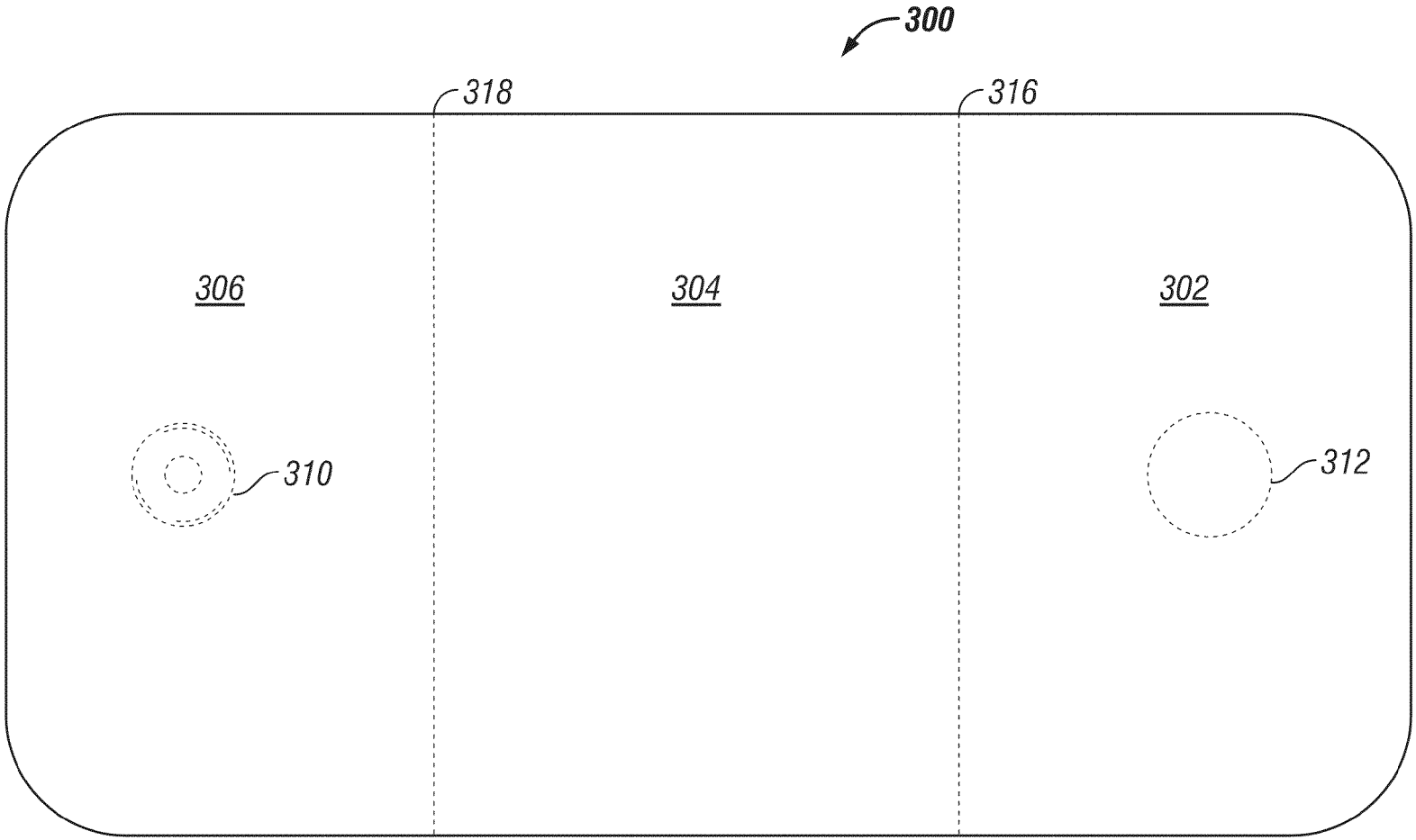
FIG. 3A is an inner plan view of a reusable notecard in a flat open configuration, according to an alternative embodiment of the invention.
Figure 3B:
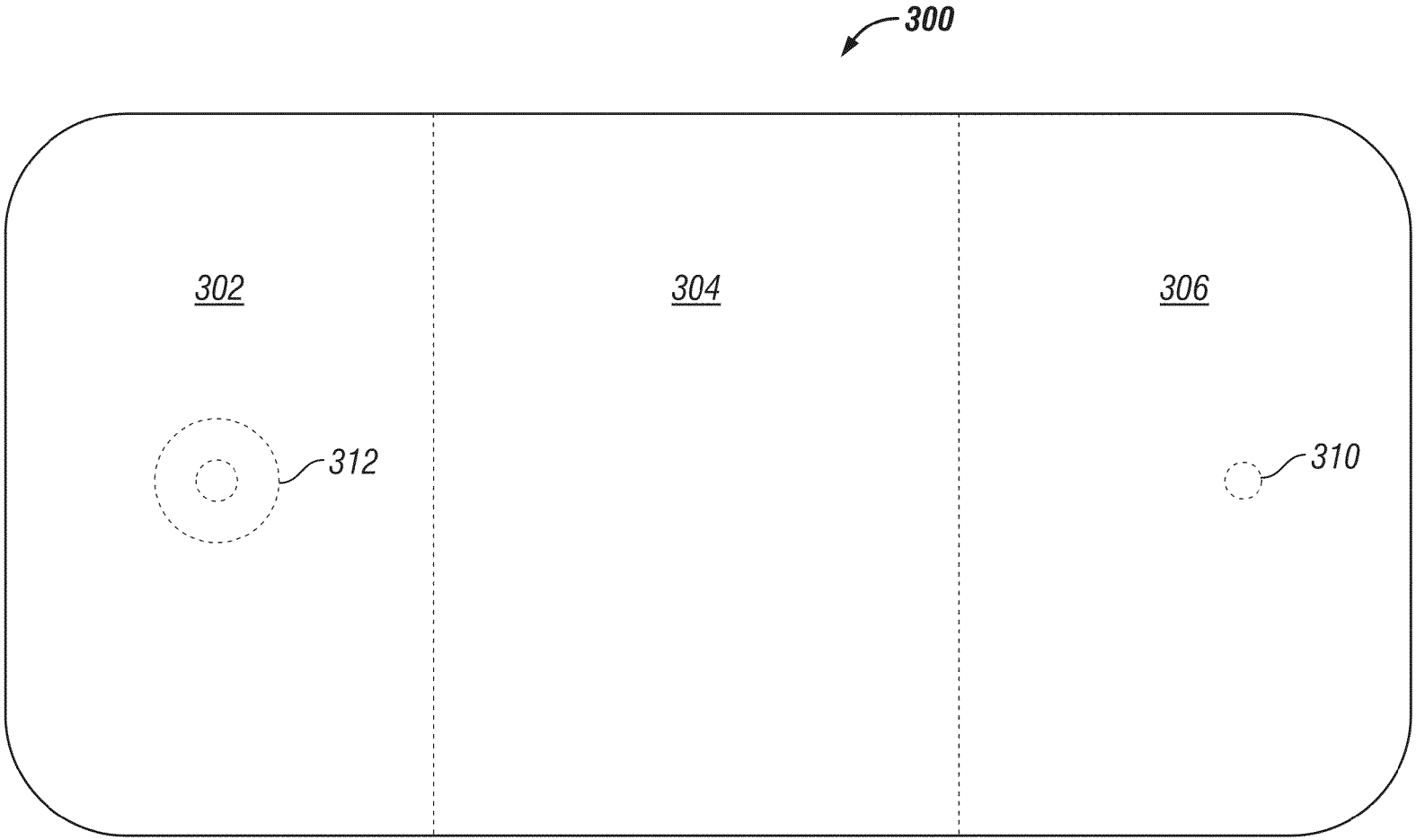
FIG. 3B is an outer plan view of the reusable notecard of FIG. 3A in a flat open configuration.

FIGS. 3A-3B are outer and inner plan views, respectively, of a reusable notecard in a flat open configuration according to an alternative embodiment of the invention. Similar to FIG. 1A and according to this embodiment, reusable notecard 300 has a trifold configuration; however, other suitable configurations are within the scope of the invention. Similar to FIG. 1A, reusable notecard 300 may be partially, substantially or completely made of a material in which non-permanent markings may be made. Such materials include, but are not limited to, poly laminate and vinyl, laminated paper or any other suitable material. In any embodiment, notecard 300 should be made of a flexible yet durable and relatively stiff material. In the trifold configuration, reusable notecard 300 includes a left panel 302, a center panel 304 and a right panel 306. Reusable notecard 300 may be approximately eight (8) inches in width and four (4) inches in height; thus, in one embodiment, left and right panels 302, 306 may be approximately two and one-half inches (2 and ½) inches in width and center panel 304 may be approximately three (3) inches in width, although other heights and widths are within the scope of the invention.

Panels 302, 304 and 306 may be created by pressing parallel, spaced-apart crease lines in notecard 300 to define fold lines. Panels 302, 304 and 306 may be generally rectangular in shape. However, in alternative embodiments, the panels may be other shapes, such as squares, ovals or other polygons. As shown in FIGS. 3A-3B, notecard 300 may include a left panel fold line 316 and a right panel fold line 318. Multiple fold lines may be included to create an expandable notecard 300 such that notecard 300 may be adapted to the dimensions of contents which may be included inside notecard, such as a note, lunch card, money, etc. Although one right panel fold line 316 and left panel fold line 318 are shown, this is by way of example only and more fold lines may be included. In any embodiment, reusable notecard 300 should be approximately pocket-sized.

Figure 3C:
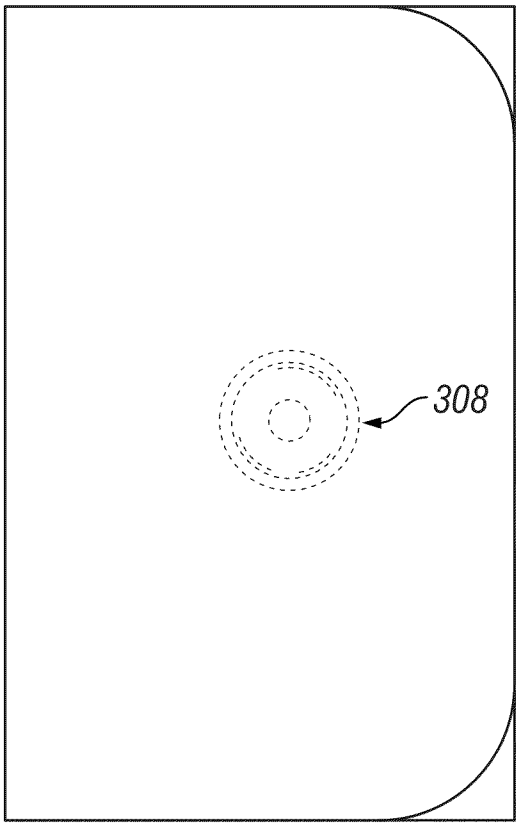
FIG. 3C is a front plan view of the reusable notecard of FIG. 3A in a closed configuration.

Reusable notecard 300 may include a reclosable closing mechanism 308. In one embodiment, reclosable closing mechanism 308 (see FIG. 3C) may be a snap. The snap 308 may include a grommeted female portion 310 that is attached in a standard manner to right panel 306 with the female portion 310 on an outside surface of right panel 310 (see FIG. 3B) and a grommeted male portion 312 that is similarly attached in a standard manner to left panel an inside surface of left panel 302 (see FIG. 3A).

In one embodiment, the female portion 310 may be positioned approximately centered or off-centered on right panel 306. Male portion 312 may be positioned centered or approximately off-centered on left panel 302.

Snap 308 may serve to releasably secure left panel 302 to right panel 306 or vice-versa. For example, after an erasable note has been written on an inside surface of center panel 304 (also left and right panels, 302, 306, if appropriate), a user may fold left panel 302 over center panel 304. Then, the user may fold right panel 306 over left panel 302. Male portion 310 may then be inserted into female portion 312.

Advantageously, embodiments of the invention allow a user to use a reusable notecard for an unlimited number of times until the natural life of the reusable notecard expires. Erasable ink or other erasable means may be applied to an inside surface or surfaces of the reusable notecard and subsequently erased at any time. The reusable notecard according to embodiments of the invention allow for an environmentally conscientious means to write daily, weekly or monthly (or at any other time) notes to one's self or another. Moreover, the notecard according to embodiments of the invention may serve as an additional item holder to hold items such as, but not limited to, a paper note, lunch card or money. For example, the reusable notecard according to embodiments of the invention may serve as a means for a parent to write daily notes to his/her child and optionally attaching spending money for that given day. The nature of the writing can be virtually anything, for example, a note reminding the child of basketball practice with money attached for a snack later in the afternoon. Since the notecard is pocket-sized, it will easily fit into the child's lunchbox, pocket and/or book bag/backpack.

One or more of the components and functions illustrated in the figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A reusable notecard, comprising:

a trifold panel having a center panel integrally connected to and located between a pair of outer panels, the center panel and the pair of outer panels each have an interior surface and an exterior surface and wherein at least each of the outer panels in the pair of outer panels are approximately equally sized; and a reclosable closing mechanism to releasably secure a first panel of the pair of outer panels to a second outer panel of the pair of outer panels when folded over one another, wherein the trifold panel is one in which non-permanent markings may be made, the recloseable closing mechanism comprising:

a flexible tab, integrally formed into the first outer panel of the pair of outer panels by cutting an approximate half circle through a portion of the surface of the first outer panel, to form a flexible tab, the flexible tab is located off-center in the first outer panel; and a slit, integrally formed into the second outer panel of the pair of outer panels, and adapted to receive the tab, wherein the slit is sized to receive the widest portion of the tab; and wherein the flexible tab is moveable between a first position and a second position; and wherein when in the first position, the flexible tab is flush with the first outer panel and when in the second position, the flexible tab extends outwardly from the exterior surface of the first outer panel for insertion into the slit.

2. The reusable notecard of claim 1 wherein the tab is integrally positioned on the left or the right panel.

3. The reusable notecard of claim 1 wherein the slit is on the left or the right panel.

4. The reusable notecard of claim 1 further comprising an attaching member secured to the tri-fold panel for securing the contents to the notecard.

5. The reusable notecard of claim 1 wherein the first outer panel comprises a plurality of first panel fold lines and the second outer panel comprises a plurality of second panel fold lines, the plurality of first panel fold lines and the plurality of second panel fold lines for adapting to dimensions of contents inside the notecard.

6. The reusable notecard of claim 5 wherein the plurality of first panel fold lines being in close proximity and substantially parallel to each other; and wherein the plurality of second panel fold lines being in close proximity and substantially parallel to each other.

7. A reusable notecard, comprising:

a trifold panel having a center panel integrally connected to and located between a pair of outer panels, the center panel and the pair of outer panels each have an interior surface and an exterior surface and wherein at least each of the outer panels in the pair of outer panels are approximately equally sized; and a reclosable closing mechanism, connected to the trifold panel, to releasably secure a first panel of the pair of outer panels to a second outer panel of the pair of outer panels when folded over one another, wherein the trifold panel is one in which non-permanent markings may be made, the recloseable closing mechanism comprising:

a fastening member secured to the first panel; and an opening integrally formed within the second panel and off-centered thereto and adapted to receive the fastening member, the opening comprising:

a first portion having a substantially circular shape; and a second portion having a semi-elliptical shape, the second portion integrally connected to and extending perpendicularly outward from the first portion; and wherein the second panel and the opening are flexible.

8. The reusable notecard of claim 7 further comprising an attaching member releasably secured to the tri-fold panel for securing contents to the notecard.

9. The reusable notecard of claim 7 wherein the fastening member extends perpendicularly outwardly from the first outer panel.

10. The reusable notecard of claim 7 wherein the first outer panel comprises a plurality of first panel fold lines and the second outer panel comprises a plurality of second panel fold lines, the plurality of first panel fold lines and the plurality of second panel fold lines for adapting to dimensions of contents inside the notecard.

11. The reusable notecard of claim 7 wherein the plurality of first panel fold lines being in close proximity and substantially parallel to each other; and wherein the plurality of second panel fold lines being in close proximity and substantially parallel to each other.

* * * * *